US010907583B2

(12) United States Patent
Honda et al.

(10) Patent No.: US 10,907,583 B2
(45) Date of Patent: Feb. 2, 2021

(54) FUEL VAPOR PROCESSING APPARATUS

(71) Applicant: AISAN KOGYO KABUSHIKI KAISHA, Obu (JP)

(72) Inventors: Yoshihiko Honda, Obu (JP); Tsutomu Kuniyoshi, Nagoya (JP); Hiroyuki Takahashi, Nagoya (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 0 days.

(21) Appl. No.: 16/785,840

(22) Filed: Feb. 10, 2020

(65) Prior Publication Data

US 2020/0263638 A1 Aug. 20, 2020

(30) Foreign Application Priority Data

Feb. 20, 2019 (JP) ..... 2019-028186

(51) Int. Cl.
*F02M 25/08* (2006.01)

(52) U.S. Cl.
CPC ..... *F02M 25/0836* (2013.01); *F02M 25/089* (2013.01); *F02M 25/0854* (2013.01)

(58) Field of Classification Search
CPC ..... F02M 25/0836; F02M 25/0854; F02M 25/089
USPC ..... 123/518, 519; 96/121, 131, 133
See application file for complete search history.

(56) References Cited

U.S. PATENT DOCUMENTS

RE38,844 E * 10/2005 Hiltzik ..... B01D 53/02 123/519
7,604,691 B2 * 10/2009 Reiners ..... B01D 53/02 123/519
8,512,453 B2 * 8/2013 Rudolph ..... B60K 15/03504 96/6
8,992,673 B2 * 3/2015 Mani ..... B01D 53/04 96/132
9,005,352 B2 * 4/2015 Mani ..... F02M 25/0854 96/126
9,777,679 B2 10/2017 Shimokawa
2004/0083894 A1 * 5/2004 Koyama ..... F02M 25/0836 96/133

FOREIGN PATENT DOCUMENTS

JP 2016031054 A 3/2016

* cited by examiner

*Primary Examiner* — Erick R Solis
(74) *Attorney, Agent, or Firm* — Conley Rose, P.C.

(57) ABSTRACT

A fuel vapor processing apparatus includes an adsorption passage has a first end connected to a fuel tank and a second end open to the atmosphere. The adsorption passage includes a first hollow chamber, a second hollow chamber, and a third hollow chamber. In addition, the adsorption passage includes a first adsorption chamber and a second adsorption chamber. The first adsorption chamber is positioned between the first hollow chamber and the second hollow chamber, and the second adsorption chamber is positioned between the second hollow chamber and the third hollow chamber. The adsorption chambers are configured to adsorb and desorb fuel vapor. A purge passage extends from the second hollow chamber toward an internal combustion engine. A bypass passage extends from the first hollow chamber to the third hollow chamber and bypasses the second hollow chamber. The bypass passage is provided with a shutoff valve that is open during a purge operation and is closed at other times.

12 Claims, 8 Drawing Sheets

FUEL VAPOR PROCESSING APPARATUS

CROSS-REFERENCE TO RELATED APPLICATIONS

This application claims priority to Japanese patent application serial number 2019-028186 filed Feb. 20, 2019, which is incorporated herein by reference in its entirety for all purposes.

STATEMENT REGARDING FEDERALLY SPONSORED RESEARCH OR DEVELOPMENT

Not applicable.

BACKGROUND

This disclosure relates generally to fuel vapor processing apparatuses.

A vehicle, such as an automobile, is equipped with a fuel vapor processing apparatus including a canister. The canister defines an adsorption chamber filled with an adsorbent for adsorbing and desorbing fuel vapor, such as gasoline vapor, so as to prevent leakage of the fuel vapor from a fuel tank into the atmosphere.

BRIEF SUMMARY

In one aspect of this disclosure, a fuel vapor processing apparatus includes an adsorption passage having a first end and a second end. The adsorption passage includes a first hollow chamber, a second hollow chamber, a third hollow chamber, a first adsorption chamber, and a second adsorption chamber. The first hollow chamber, the first adsorption chamber, the second hollow chamber, the second adsorption chamber, and the third hollow chamber are arranged in series in the adsorption passage in the recited order. The first and second adsorption chambers are filled with an adsorbent configured to adsorb and desorb fuel vapor. The fuel vapor processing apparatus further includes a vapor passage, an atmospheric passage, a purge passage, and a bypass passage. The vapor passage connects a fuel tank to the first end of the adsorption passage. The atmospheric passage is connected to the second end of the adsorption passage and is configured to be in communication with the atmosphere when a purge operation is performed. The purge passage extends from the second hollow chamber toward an internal combustion engine. The bypass passage is in fluid communication with the first hollow chamber and the third hollow chamber and bypasses the second hollow chamber. A shutoff valve is disposed along the bypass passage and is configured to open when the purge operation is performed and to close when the purge operation is not performed.

According to this aspect, when the purge operation is not performed, the shutoff valve is closed. Thus, the fuel vapor vaporized in the fuel tank flows through the first, second and third adsorption chambers in series. The fuel vapors are adsorbed in the first, second and third adsorption chambers. Accordingly, leakage of the fuel vapor into the atmosphere while the purge operation is not carried out is prevented. When the shutoff valve is opened during the purge operation, the atmospheric air flows into the adsorption passage via the atmospheric passage. A portion of the atmospheric air flows through the second adsorption chamber positioned between the second hollow chamber and the third hollow chamber. This portion of the atmospheric air flows from the atmospheric passage to the purge passage without passing through the bypass passage. The other portion of the atmospheric air flows through the first adsorption chamber positioned between the first hollow chamber and the second hollow chamber. This other portion of the atmospheric air flows from the atmospheric passage to the purge passage via the bypass passage. That is, the atmospheric air introduced into the adsorption passage flows through the first adsorption chamber and the second adsorption in parallel. Accordingly, desorption efficiency of the fuel vapor can be improved during the purge operation. Due to this configuration, the leakage of the fuel vapor into the atmosphere can be prevented while the purge operation is not being performed. In addition, the desorption efficiency of the fuel vapor during the purge operation can be improved.

Other objects, features and advantage of the present teaching will be readily understood after reading the following detailed description together with the accompanying drawings and the claims.

BRIEF DESCRIPTION OF THE DRAWINGS

For a detailed description of the embodiments of the present teaching, reference will now be made to the accompanying drawings.

DETAILED DESCRIPTION

Figure 1:
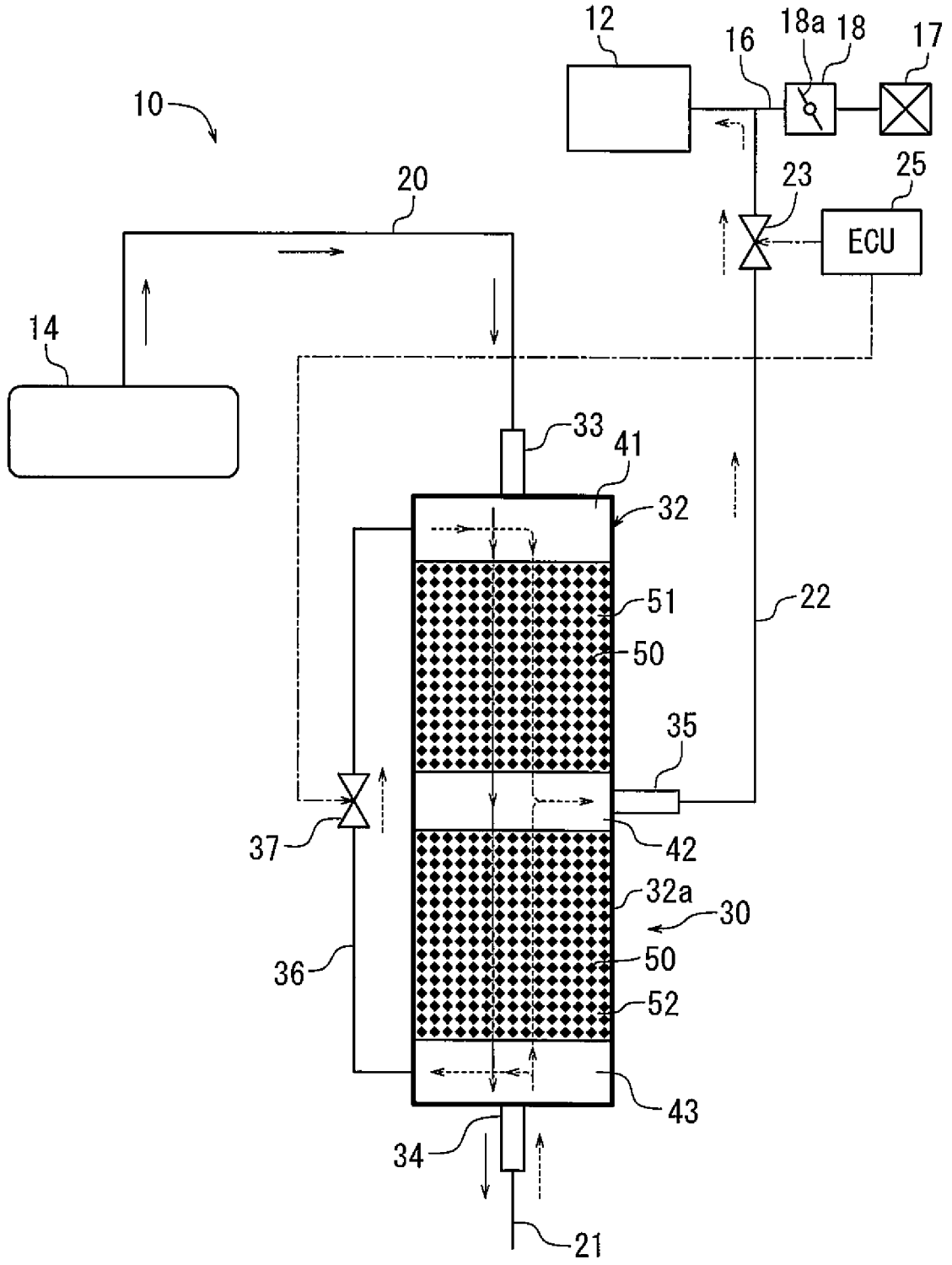
FIG. 1 is a schematic view of a first embodiment of a vapor leakage prevention system in accordance with principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that particular embodiment.

Certain terms are used throughout the following description and claims to refer to particular features or components. As one skilled in the art will appreciate, different people may refer to the same feature or component by different names. This document does not intend to distinguish between components or features that differ in name but not function. The drawing figures are not necessarily to scale. Certain features and components herein may be shown exaggerated in scale or in somewhat schematic form. Some details of conventional elements may not be shown in interest of clarity and conciseness.

In the following discussion and in the claims, the terms "including" and "comprising" are used in an open-ended fashion, and thus should be interpreted to mean "including, but not limited to . . . ," etc. Also, the term "couple(d)" or "couples" is intended to mean either an indirect or direct connection. Thus, if a first device couples to a second device, that connection may be through a direct connection, or through an indirect connection via other devices, components, and/or connections.

Each of the additional features and teachings disclosed above and below may be utilized separately or in conjunction with other features and teachings to provide improved fuel vapor processing apparatuses. Representative examples of the present teachings, which utilized many of these additional features and teachings both separately and in conjunction with one another, will now be described in detail with reference to the attached drawings. This detailed description is merely intended to teach a person skilled in the art further details for practicing aspects of the present teachings, and is not intended to limit the scope of the claimed subject-matter. Only the claims define the scope of the claimed subject-matter. Therefore, combinations of features and steps disclosed in the following detailed description may not be necessary to practice the claimed subject-matter in the broadest sense, and are instead taught merely to particularly describe representative examples of the present teachings. Moreover, various features of the representative examples and the dependent claims may be combined in ways that are not specifically enumerated in order to provide additional useful embodiments of the present teachings.

As previously described, a vehicle, such as an automobile, is equipped with a including the canister of a vehicle fuel vapor processing apparatus defines an adsorption chamber filled with an adsorbent for adsorbing and desorbing fuel vapor so as to prevent leakage of the fuel vapor from a fuel tank into the atmosphere. Japanese Laid-Open Patent Publication No. 2016-31054 discloses one type of canister for a fuel vapor processing apparatus. The canister includes a bypass passage between a purge port and an atmospheric port so as to bypass a part of the adsorption chamber of the canister. The bypass passage is provided with a shutoff valve that controls the ratio of flow in the bypass passage when a flow velocity of the gas exceeds a predetermined value during a purge operation. Thus, when the shutoff valve is opened during the purge operation, the gas flows through the bypass passage, so that the ratio of the gas flowing through a part of the adsorption chamber decreases. Accordingly, pressure losses in the canister during the purge operation can be reduced.

When using the canister disclosed in Japanese Laid-Open Patent Publication No. 2016-31054, the shutoff valve is closed until the flow velocity of the gas exceeds the predetermined value during the purge operation. Accordingly, the part of the adsorption chamber on the tank port side, where the density of the fuel vapor is high, is supplied with only a low-temperature purge gas, which has been cooled by desorption of the fuel vapor on the atmospheric port side. Thus, the desorption efficiency of the fuel vapor from the adsorbent on the tank port side is low. On the contrary, when the shutoff valve is open, the atmospheric gas flows through the adsorption chamber on the purge port side. The speed of this atmospheric gas is increased by confluence of the gas flowing through the adsorption chamber on the atmospheric port side and the gas flowing through the bypass passage. Thus, the adsorbent near the purge port side is drastically cooled, causing the desorption efficiency of the fuel vapor from the adsorbent on the purge port side to be decreased. Therefore, there is a need for improved fuel vapor processing apparatuses.

A first embodiment will be described with reference to accompanying drawings. The first embodiment of a fuel vapor processing apparatus is a vapor leakage prevention system 10 including a canister 30, which is mounted on a vehicle having an internal combustion engine 12.

As shown in FIG. 1, the vapor leakage prevention system 10 includes the engine 12 and a fuel tank 14. The engine 12 may be a gasoline engine. The engine 12 has an intake port connected to an air intake passage 16. The air intake passage 16 is provided with an air cleaner 17 on an upstream side. A throttle apparatus 18 including a throttle valve 18*a* is positioned along the air intake passage 16 between the engine 12 and the cleaner 17.

The canister 30 is connected to the fuel tank 14 via a vapor passage 20. The canister 30 is open to the atmosphere via an atmospheric passage 21. The canister 30 is connected to the air intake passage 16 via a purge passage 22. The purge passage 22 is provided with a purge valve 23. The purge valve 23 may comprise a solenoid valve and is controlled to be opened or closed by an engine control unit (ECU) 25. The purge valve 23 is opened during a purge operation and is closed at other times.

The canister 30 includes a canister housing 32 having a hollow cylindrical shape and defining a adsorption passage 32*a* that extends linearly. The canister housing 32 has a tank port 33, an atmospheric port 34, and a purge port 35. The tank port 33 is formed at one end of the canister housing 32 so as to directly communicate one end of the adsorption passage 32*a* with the exterior of the canister housing 32. The atmospheric port 34 is formed at the other end of the canister housing 32 so as to directly communicate the other end of the adsorption passage 32*a* with the exterior of the canister housing 32. The purge port 35 is formed at the middle of the canister housing 32 so as to directly communicate a central portion of the adsorption passage 32*a* with the exterior of the canister housing 32.

The adsorption passage 32*a* includes a first hollow chamber 41, a first adsorption chamber 51, a second hollow chamber 42, a second adsorption chamber 52, and a third hollow chamber 43 that are arranged in series and aligned linearly from the tank port 33 side of passage 32*a* to the atmospheric port 34 side of passage 32*a*. Each of the first adsorption chamber 51 and the second adsorption chamber 52 is filled with an adsorbent 50, such as an activated carbon, configured to adsorb and desorb the fuel vapor. The first hollow chamber 41, the second hollow chamber 42, and the third hollow chamber 43 do not contain an adsorbent 50 therein. The first adsorption chamber 51 positioned between the first hollow chamber 41 and the second hollow chamber 42 is in direct fluid communication with the first hollow chamber 41 and the second hollow chamber 42. The second adsorption chamber 52 positioned between the second hollow chamber 42 and the third hollow chamber 43 is in direct fluid communication with the second hollow chamber 42 and the third hollow chamber 43.

The first hollow chamber 41 may also be referred to as "a hollow chamber on one end side of an adsorption chamber" or "a first hollow chamber positioned at a vapor passage side" in this disclosure. The second hollow chamber 42 may also be referred to as "a second hollow chamber positioned at a vapor passage side" or "a hollow chamber connected to a purge passage" in this disclosure. The third hollow chamber 43 may also be referred to as "a hollow chamber on the other end side of an adsorption chamber" or "a hollow chamber positioned closer to the atmospheric passage side than a hollow chamber connected to a purge passage" in this disclosure.

The first hollow chamber 41 is in fluid communication with the tank port 33. The tank port 33 is connected to a canister side end of the vapor passage 20. The second hollow chamber 42 is in fluid communication with the purge port 35. The purge port 35 is connected to a canister side end of the purge passage 22. The third hollow chamber 43 is in fluid communication with the atmospheric port 34. The atmospheric port 34 is connected to a canister side end of the atmospheric passage 21.

The first hollow chamber 41, the first adsorption chamber 51, the second hollow chamber 42, the second adsorption chamber 52, and the third hollow chamber 43 have the same inner shape or substantially the same inner shape as each other. In this disclosure, the term "inner shape" may be used to refer to each of the inner shapes of the hollow chambers 41, 42, 43 and the adsorption chambers 51, 52 in a cross-sectional plane perpendicular to a flow direction in the adsorption passage 32*a*.

The first hollow chamber 41 and the third hollow chamber 43 are connected to each other via a bypass passage 36. The bypass passage 36 is provided with a shutoff valve 37 comprising a solenoid valve. The shutoff valve 37 is controlled to be opened and closed by the ECU 25 so as to be synchronized with the purge valve 23. Thus, the shutoff valve 37 is opened during the purge operation and is closed at other times. In this embodiment, the bypass passage 36 and the shutoff valve 37 are integrally formed with the canister housing 32.

An operation of the vapor leakage prevention system 10 will now be described. While the purge operation is not being performed, e.g. during parking or refueling, the purge valve 23 and the shutoff valve 37 are closed. In this state, a mixed gas containing air and the fuel vapor vaporized in the fuel tank is introduced into the adsorption passage 32*a* via the vapor passage 20 and the tank port 33. The mixed gas flows through the first hollow chamber 41, the first adsorption chamber 51, the second hollow chamber 42, the second adsorption chamber 52, and the third hollow chamber 43 in order. During this process, the fuel vapor to be adsorbed by the adsorbent 50 within the adsorption chambers 51, 52. After the adsorbent 50 adsorbs the fuel vapor, clean air is released into the atmosphere via the atmospheric port 34 and the atmospheric passage 21. In FIG. 1, solid arrows show the flow of the mixed gas in a state where the purge operation is not being performed.

Next, an operation of the vapor leakage prevention system 10 during a purge operation will be described. When the purge valve 23 and the shutoff valve 37 are opened by the ECU 25, e.g. while the engine 12 is running, negative pressure in the air intake passage 16 of the engine 12 is applied to the adsorption passage 32*a* via the purge passage 22. As a result, atmospheric air, i.e. fresh air, flows into the adsorption passage 32*a* of the canister housing 32 via the atmospheric passage 21 and the atmospheric port 34. A portion of the intaken air flows through the third hollow chamber 43 and the second adsorption chamber 52 into the second hollow chamber 42. The remaining portion of the intaken air flows through the third hollow chamber 43, the bypass passage 36, the first hollow chamber 41, and the first adsorption chamber 51 into the second hollow chamber 42. During this process, the fuel vapor is desorbed from the adsorbent 50 in the respective adsorption chambers 51, 52 and is mixed with the air. The resulting gas containing the air and the desorbed fuel vapor is referred to as "purge gas" in this disclosure. The purge gas is supplied to the air intake passage 16 via the purge port 35 and the purge passage 22. In FIG. 1, dashed arrows show the flow of the air and the purge gas during the purge operation. The second adsorption chamber 52 may also be referred to as "an atmospheric passage side adsorption chamber" in this disclosure. The first adsorption chamber 51 may also be referred to as "a vapor passage side adsorption chamber" in this disclosure.

In accordance with the first embodiment, the shutoff valve 37 is closed while the purge operation is not being carried out. Thus, the fuel vapor vaporized in the fuel tank 14 flows linearly through the first adsorption chamber 51 and the second adsorption chamber 52 in series from the vapor passage 20 side to the atmospheric passage 21 side. Thus, the fuel vapor is adsorbed by the adsorbent 50 in the adsorption chambers 51, 52. Due to this configuration, leakage of the fuel vapor into the atmosphere can be prevented while the purge operation is not being performed.

When the purge valve 23 and the shutoff valve 37 are opened during the purge operation, atmospheric air flows into the third hollow chamber 43 via the atmospheric port 34. Then, a portion of the atmospheric air flows through the second adsorption chamber 52 and the second hollow chamber 42 into the purge passage 22. The remaining portion of the atmospheric air flows through the bypass passage 36, the first hollow chamber 41, the first adsorption chamber 51, and the second hollow chamber 42 into the purge passage 22. That is, the atmospheric air introduced via the atmospheric passage 21 flows through the adsorption chambers 51, 52 in parallel. Due to this configuration, each of the adsorption chambers 51, 52 is supplied with atmospheric air not containing fuel vapor. As a result, the desorption efficiency of the fuel vapor during the purge operation can be improved. Accordingly, leakage of the fuel vapor into the atmosphere can be suppressed while the purge operation is not performed. Additionally, the desorption efficiency of the fuel vapor during the purge operation can be improved.

The atmospheric air is introduced from the outside, and thus is usually warmer than the purge gas flowing through the purge passage 22. Because desorption of fuel vapor from the adsorbent 50 needs heat, warmer air can facilitate desorption of the fuel vapor. In addition, the air flows through the adsorption chambers 51, 52 in parallel. Thus, the adsorbed fuel vapor can be desorbed from the adsorbent 50 efficiently, while also reducing unevenness in desorption of the adsorption chambers 51, 52.

In contrast to a case where atmospheric air is introduced to the adsorption chambers in series during the purge operation, the flow velocity of air flowing through the adsorption chambers 51, 52 in parallel is relatively low. Thus, rapid cooling of the adsorbent 50 in the adsorption chambers 51, 52 can be prevented, thereby suppressing a decrease in the desorption efficiency of the fuel vapor from the adsorbent 50.

While the purge operation is not being carried out, the shutoff valve 37 is closed so as to block fluid communication between the first hollow chamber 41 and the third hollow chamber 43 via the bypass passage 36. Thus, the fuel vapor flows through the adsorption passage 32*a* linearly, that is through the first adsorption chamber 51 and the second adsorption chamber 52 in series. So, the fuel vapor can be efficiently adsorbed by the adsorbent 50 in the adsorption chambers 51, 52, thereby preventing leakage of the fuel vapor into the atmosphere.

While the purge operation is being performed, the relatively warm atmospheric air in the third hollow chamber 43 flows through the adsorption chambers 51, 52 in parallel. So, when the air flows into the adsorption chambers 51, 52, it has not been previously cooled by vaporization of the fuel vapor, and thus is warm. Therefore, the fuel vapor can be efficiently purged from the adsorbent 50 in both the second adsorption chamber 52 and the first adsorption chamber 51. Accordingly, the residual amount of the fuel vapor in either of the adsorption chambers 51, 52 can be reduced. This in turn effectively increases the fuel vapor adsorption capacity while the purge operation is not being carried out.

The first hollow chamber 41, the first adsorption chamber 51, the second hollow chamber 42, the second adsorption chamber 52, and the third hollow chamber 43 have the same or almost the same inner shape as each other. Thus, gas can flow from the first hollow chamber 41 to the first adsorption chamber 51, from the second hollow chamber 42 to the second adsorption chamber 52, or from the third hollow chamber 43 to the second adsorption chamber 52 without much disturbance.

In this embodiment, the canister housing 32 is integrally formed with the bypass passage 36 and the shutoff valve 37. Consequently, the canister 30 can be mounted on a vehicle by only attaching the canister housing 32 to a vehicle body. Then, the tank port 33, the purge port 35, and the atmospheric port 34 can be connected to the vapor passage 20, the purge passage 22, and the atmospheric passage 21, respectively. Accordingly, in comparison with a case where the canister housing 32, the bypass passage 36, and the shutoff valve 37 are mounted on the vehicle separately, the mountability of the canister 30 on the vehicle can be improved.

In other embodiments, one or more of the hollow chambers 41, 42, 43 may have an inner shape different from that of the first adsorption chamber 51 and/or the second adsorption chamber 52. Further, in some embodiments, the bypass passage 36 and the shutoff valve 37 may be separate from the canister housing 32.

Figure 2:
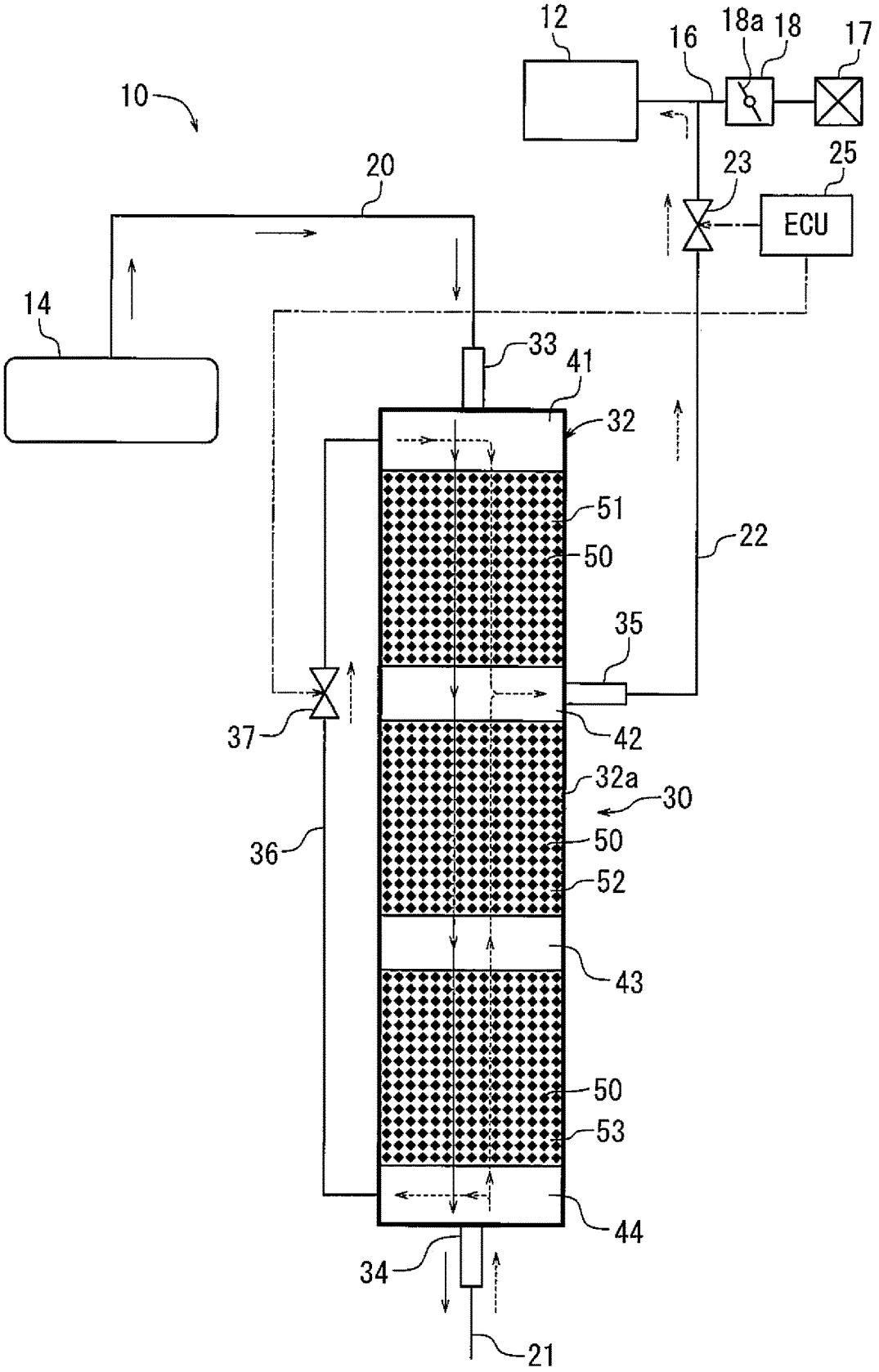
FIG. 2 is a schematic view of a second embodiment of a vapor leakage prevention system in accordance with principles described herein.

A second embodiment will now be described. The second embodiment is substantially the same as the first embodiment described above. Thus, while the differences will be described, substantially similar configurations will not be described in the interest of conciseness. As shown in FIG. 2, the adsorption passage 32*a* of the canister 30 may additionally include a third adsorption chamber 53 and a fourth hollow chamber 44 positioned between the third hollow chamber 43 and the atmospheric port 34.

The third adsorption chamber 53 and the fourth hollow chamber 44 have substantially the same configurations as the second adsorption chamber 52 and the third hollow chamber 43, respectively. The third adsorption chamber 53 is positioned adjacent to the third hollow chamber 43 and the fourth hollow chamber 44 so as to be in a direct fluid communication with these hollow chambers 43, 44. The bypass passage 36 connects the first hollow chamber 41 to the fourth hollow chamber 44. In FIG. 2, solid arrows show the flow of the air and fuel vapor mixture form the fuel tank 14 in a state where the purge operation is not being performed. Dashed arrows show the flow of the atmospheric air and the purge gas during the purge operation. The fourth hollow chamber 44 may also be referred to as "a hollow chamber on the other end side of an adsorption chamber" or "a hollow chamber positioned closer to the atmospheric passage side than a hollow chamber connected to a purge passage" in this disclosure.

Since the adsorption passage 32*a* of the canister 30 of the second embodiment includes the third adsorption chamber 53, the adsorption capacity for the fuel vapor can be increased in comparison with the first embodiment.

Figure 3:
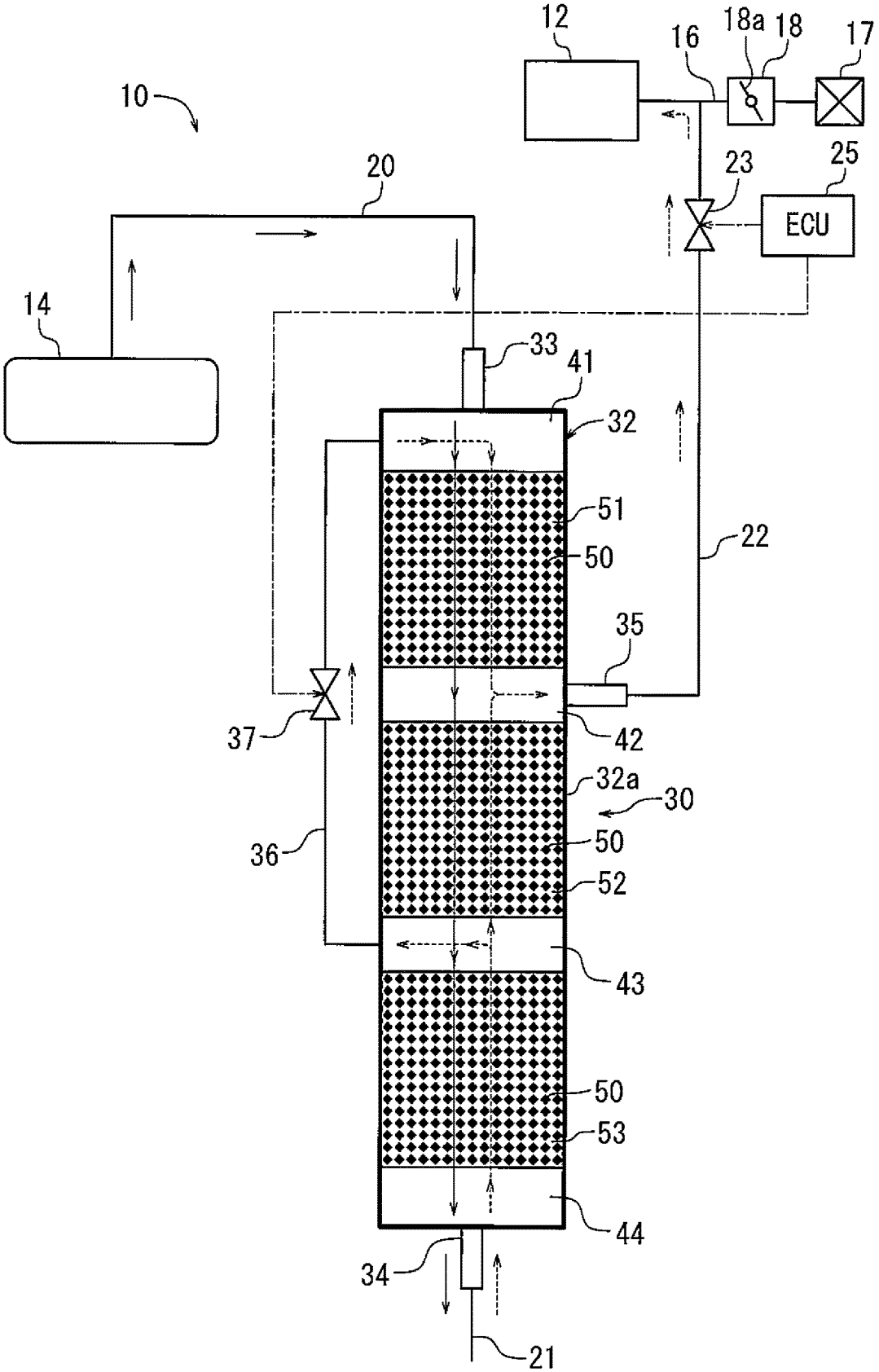
FIG. 3 is a schematic view of a third embodiment of a vapor leakage prevention system in accordance with principles described herein.

A third embodiment will now be described. The third embodiment is substantially the same as the second embodiment described above. Thus, while the differences will be described, similar configurations will not be described in the interest of conciseness. As shown in FIG. 3, one end of the bypass passage 36 is connected to the third hollow chamber 43, and the other end is connected to the first hollow chamber 41. In FIG. 3, solid arrows show the flow of air and fuel vapor in a state where the purge operation is not being performed. Dashed arrows show the flow of atmospheric air and purge gas during a purge operation.

The length of the bypass passage 36 of the third embodiment can be shortened in comparison with the second embodiment. Accordingly, manufacturing costs can be decreased. During the purge operation, the atmospheric air introduced into the third hollow chamber 43 via the atmospheric passage 21 and the third adsorption chamber 53 flows through the first adsorption chamber 51 and the second adsorption chamber 52 in parallel. Thus, the purge gas containing the atmospheric air and the fuel vapor from the third adsorption chamber 53 can be distributed to the first adsorption chamber 51 and the second adsorption chamber 52 almost evenly so as to purge the fuel vapor from the adsorption chambers 51, 52 almost equally. In addition, the fuel vapor adsorption capacity of the adsorbent 50 in the third adsorption chamber 53 is less than those of the adsorbent 50 in the other adsorption chambers 51, 52. Thus, when the atmospheric air flows through the third adsorption chamber 53, the temperature drop of the air is small. This reduces the influence on the desorption efficiency of the fuel vapor from the adsorbent 50 in the adsorption chambers 51, 52.

A fourth embodiment will now be described. The fourth embodiment is substantially the same as the second embodiment described above except with regard to some changes of the shape and layout of the canister. Thus, while the changes will be described, similar configurations will not be described in the interest of conciseness.

A canister 130 of the fourth embodiment includes a canister housing 132 having a hollow rectangular parallelepiped shape. The canister housing 132 includes a partition wall 132*b* so as to define an adsorption passage 132*a* having two parallel straight portions and one bent portion that connects the straight portions to each other. Accordingly, an adsorption passage 132*a* is substantially U-shaped. The canister housing 132 includes a tank port 133 on one end side of the adsorption passage 132*a*, an atmospheric port 134 on the other end side of the adsorption passage 132*a*, and a purge port 135 on a bent side of the adsorption passage 132*a*.

A first hollow chamber 141 and a first adsorption chamber 151 are provided along one (e.g., an upper one in FIG. 4) straight portion of the adsorption passage 132*a*. The first hollow chamber 141 is in direct fluid communication with the tank port 133. A second adsorption chamber 152, a third hollow chamber 143, a third adsorption chamber 153, and a fourth hollow chamber 144 are provided along the other (e.g., a lower one in FIG. 4) straight portion of the adsorption passage 132*a*. The fourth hollow chamber 144 is in direct fluid communication with the atmospheric port 134. A second hollow chamber 142 is provided along the bent portion of the adsorption passage 132*a*. The second hollow chamber 142 is in fluid direct communication with the purge port 135. The second hollow chamber 142 is positioned adjacent to and in fluid communication with both the first adsorption chamber 151 and the second adsorption chamber 152.

Figure 4:
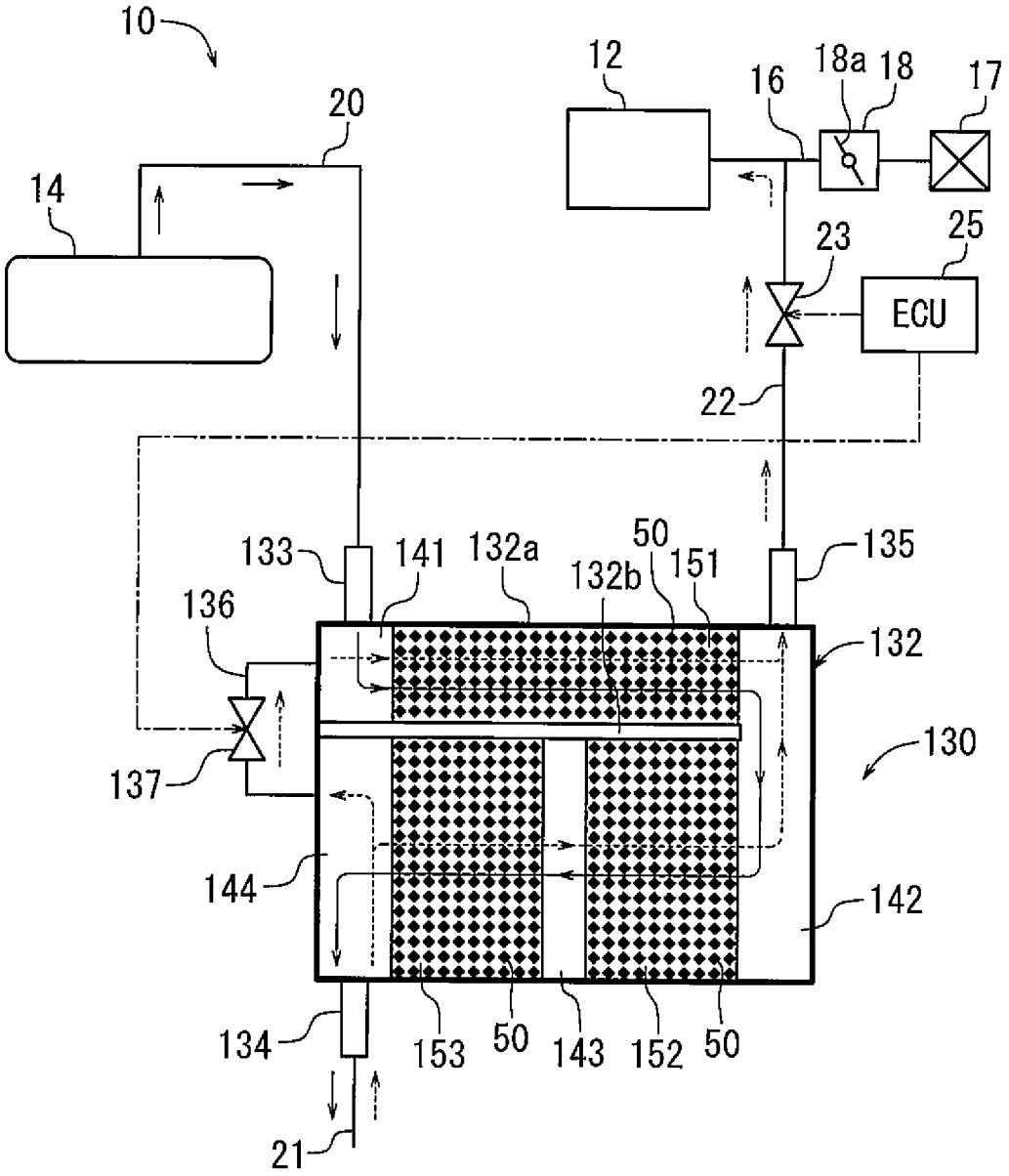
FIG. 4 is a schematic view of a fourth embodiment of a vapor leakage prevention system in accordance with principles described herein.

A bypass passage 136 connects the first hollow chamber 141 to the fourth hollow chamber 144. The bypass passage 136 is provided with a shutoff valve 137. In this embodiment, the bypass passage 136 and the shutoff valve 137 are integrated with the canister housing 132. In FIG. 4, solid arrows show the flow of the air and fuel vapor mixture from the fuel tank 14 in a state where the purge operation is not being carried out. The dashed arrows show the flow of the atmospheric air and purge gas during the purge operation. In other embodiments, the bypass passage 136 and the shutoff valve 137 are separate from the canister housing 132.

The first hollow chamber 141 may also be referred to as "a hollow chamber on one end side of an adsorption chamber" or "a first hollow chamber from a vapor passage side" in this disclosure. The second hollow chamber 142 may also be referred to as "a second hollow chamber positioned at a vapor passage side" or "a hollow chamber connected to a purge passage" in this disclosure. The third hollow chamber 143 may also be referred to as "a hollow chamber on the other end side of an adsorption chamber" or "a hollow chamber positioned closer to the atmospheric passage side than a hollow chamber connected to a purge passage" in this disclosure. The fourth hollow chamber 144 may also be referred to as "a hollow chamber on the other end side of an adsorption chamber" or "a hollow chamber positioned closer to the atmospheric passage side than an hollow chamber connected to a purge passage" in this disclosure.

The length of the canister housing 132 in a longitudinal direction of the adsorption passage 132*a* (the horizontal direction in FIG. 4) of the fourth embodiment can be decreased, so that the mountability of the canister 130 on the vehicle or the like can be improved.

The first hollow chamber 141 and the first adsorption chamber 151 have the same inner shape or substantially the same inner shape as each other. Thus, the gas can flow from the first hollow chamber 141 to the first adsorption chamber 151 without much disturbance.

The second adsorption chamber 152, the third hollow chamber 143, the third adsorption chamber 153, and the fourth hollow chamber 144 have the same inner shape or almost the same inner shape as each other. Thus, the gas can flow from the third hollow chamber 143 to the third adsorption chamber 153, from the fourth hollow chamber 144 to the third adsorption chamber 153, or from the third hollow chamber 143 to the second adsorption chamber 152 without much disturbance.

Figure 5:
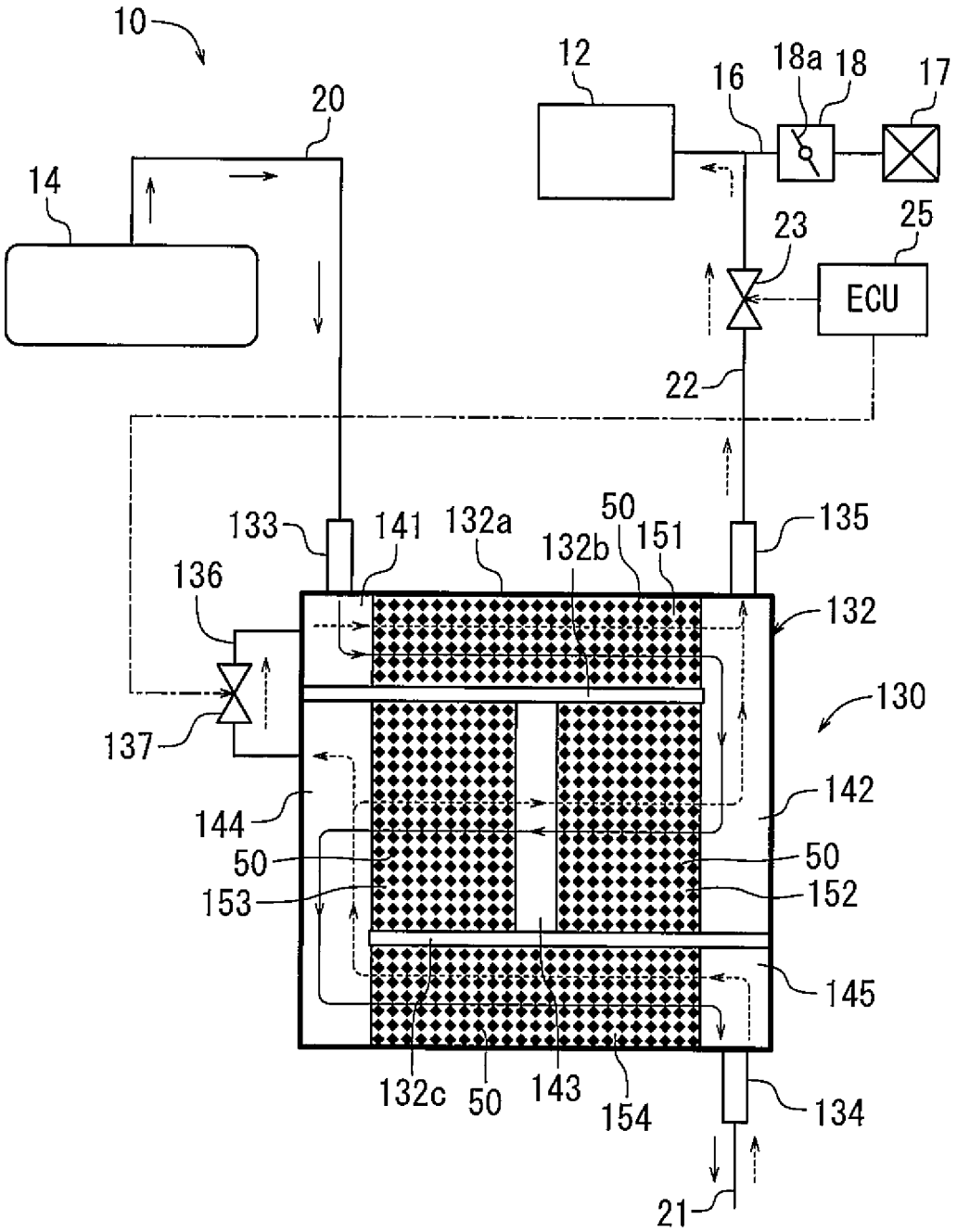
FIG. 5 is a schematic view of a fifth embodiment of a vapor leakage prevention system in accordance with principles described herein.

A fifth embodiment will now be described. The fifth embodiment is substantially the same as the fourth embodiment described above with some changes regarding the shape and layout of the canister 130. Thus, while the changes will be described, similar configurations will not be described in the interest of conciseness. As shown in FIG. 5, the canister housing 132 includes an auxiliary partition wall 132*c* parallel to the partition wall 132*b* so as to define an adsorption passage 132*a* having three parallel straight portions and two bent portions. In particular, the adsorption passage 132*a* is formed such that one end of the middle straight portion is connected to the upper straight portion via one bent portion, and the other end of the middle straight portion is connected to the lower straight portion via the other bent portion.

A fourth adsorption chamber 154 and a fifth hollow chamber 145 are formed in the lower straight portion of the adsorption passage 132*a*. The canister housing 132 has the atmospheric port 134 on one end of the lower straight portion, such that the fifth hollow chamber 145 is in fluid communication with the atmospheric port 134. The fifth hollow chamber 145 is adjacent to the fourth adsorption chamber 154 so as to be in fluid communication with the fourth adsorption chamber 154. A fourth hollow chamber 144 is formed in the bent portion between the middle straight portion and the lower straight portion. The fourth hollow chamber 144 is adjacent to both the third adsorption chamber 153 and the fourth adsorption chamber 154 so as to be in fluid communication with them. In FIG. 5, solid arrows show the flow of the fuel vapor and air mixture in a state where the purge operation is not being performed. The dashed arrows show the flow of the atmospheric air and the purge gas during the purge operation. The fifth hollow chamber 145 may also be referred to as "a hollow chamber on the other end side of an adsorption chamber" or "a hollow chamber positioned closer to the atmospheric passage side than an hollow chamber connected to a purge passage" in this disclosure.

Since the canister 130 of the fifth embodiment additionally includes the fourth adsorption chamber 154, the adsorption capacity for the fuel vapor can effectively be increased compared to the fourth embodiment.

The fifth hollow chamber 145 and the fourth adsorption chamber 154 have the same or almost the same inner shape as each other. Thus, the gas can flow from the fifth hollow chamber 145 to the fourth adsorption chamber 154 without much disturbance.

In some embodiments, various hollow chambers and/or adsorption chambers may be spaced apart so as to be disposed in different canisters. In some embodiments, the spaced apart chambers may be connected by one or more passageway so as to, in effect, function as a single chamber. One embodiment of such spaced apart chambers will be described with reference to the sixth embodiment. The sixth embodiment is similar to the fourth embodiment described above. Thus, while the differences will be described, similar configurations will not be described in the interest of conciseness.

Figure 6:
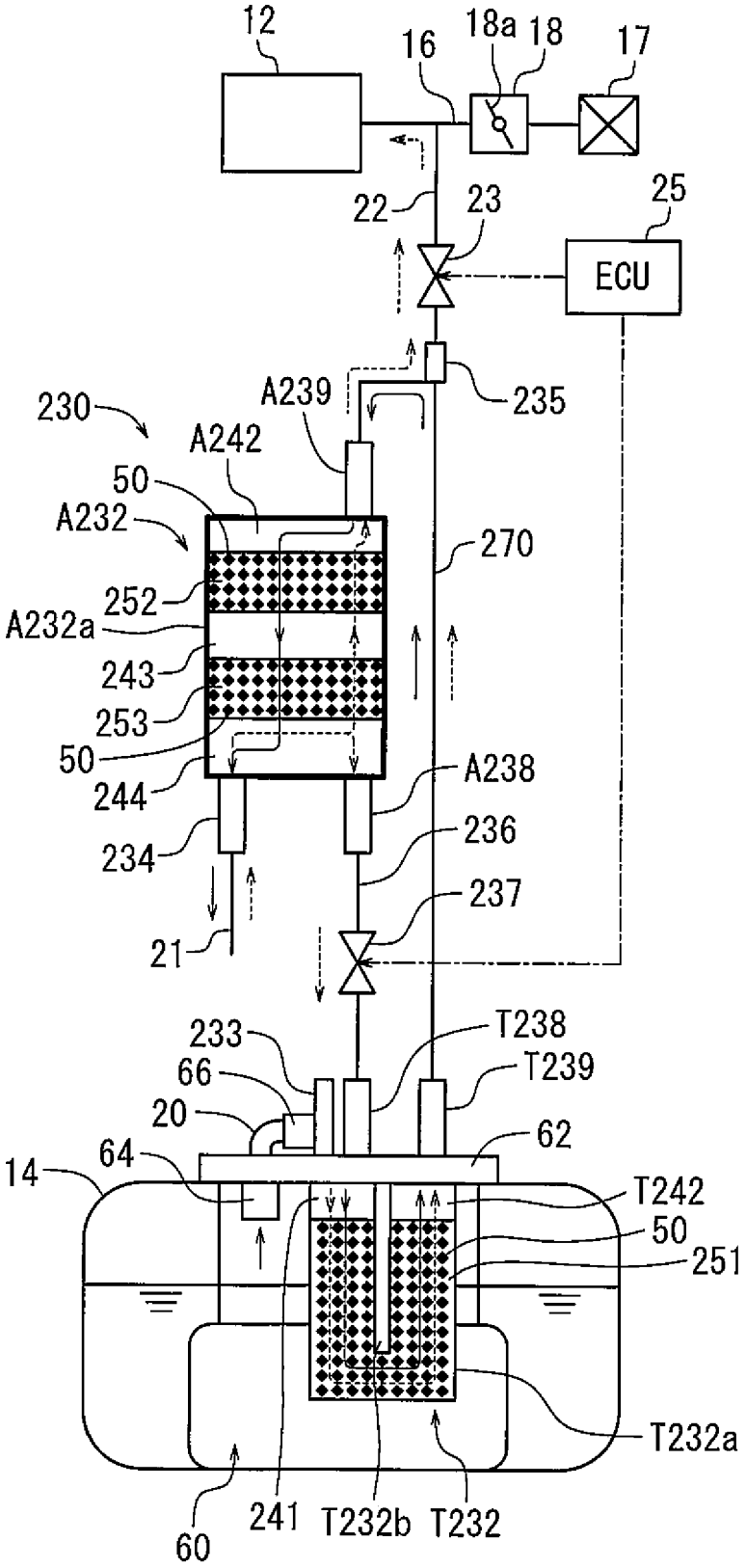
FIG. 6 is a schematic view of a sixth embodiment of a vapor leakage prevention system in accordance with principles described herein.

As shown in FIG. 6, the fuel tank 14 includes a fuel pump module 60 therein. The fuel pump module 60 may be used to supply liquid fuel from the fuel tank 14 to the engine 12. The fuel pump module 60 includes a lid 62 closing an upper opening of the fuel tank 14. The lid 62 includes the vapor passage 20 providing fluid communication between the inside and the outside of the fuel tank 14. The vapor passage 20 is provided with a cut-off valve 64, a tank pressure control valve 66, etc. The cut-off valve 64 is opened and closed by the buoyancy of the liquid fuel so as to prevent leakage of the liquid fuel from the fuel tank 14 when the vehicle flips over. The tank pressure control valve 66 controls the internal pressure of the fuel tank 14.

A canister 230 of the sixth embodiment includes an atmospheric side canister housing A232 disposed outside the fuel tank 14 and a tank side canister housing T232 disposed in the fuel tank 14. The atmospheric side canister housing A232 includes an atmospheric side second hollow chamber A242. The tank side canister housing T232 includes a tank side second hollow chamber T242.

The tank side canister housing T232 is integrated with a lower surface of the lid 62. The tank side canister housing T232 is housed in the fuel tank 14. The tank side canister housing T232 has a hollow rectangular parallelepiped shape. The tank side canister housing T232 includes a partition wall T232*b* therein so as to define a tank side adsorption passage T232*a* that is substantially U-shaped. The tank side canister housing T232 has a tank port 233, a bypass passage port T238, and a connection passage port T239. The tank port 233 and the bypass passage port T238 are formed on one end side of the tank side adsorption passage T232*a*. The connection passage port T239 is formed on the other end side of the tank side adsorption passage T232*a*. The tank port 233, the bypass passage port T238, and the connection passage port T239 extend upward from the lid 62. The tank port 233 is in fluid communication with the interior of the fuel tank 14 via the vapor passage 20.

The tank side adsorption passage T232*a* includes a first hollow chamber 241, a first adsorption chamber 251, and the tank side second hollow chamber T242 in series from the one end side of the tank side adsorption passage T232*a* to the other end side thereof. The first hollow chamber 241 is in fluid communication with both the tank port 233 and the bypass passage port T238. The tank side second hollow chamber T242 is in fluid communication with the connection passage port T239. The first adsorption chamber 251 is substantially U-shaped and extends around the partition wall T232*b*. The first adsorption chamber 251 is in fluid communication with both the first hollow chamber 241 and the tank side second hollow chamber T242. The first hollow chamber 241 and one end of the first hollow chamber 241 have the same or substantially the same inner shape as each other. The tank side second hollow chamber T242 and the other end of the first hollow chamber 241 have the same or substantially the same inner shape as each other.

The atmospheric side canister housing A232 is disposed outside the fuel tank 14. The atmospheric side canister housing A232 defines an atmospheric side adsorption passage A232*a* having a straight shape. The atmospheric side canister housing A232 has an atmospheric port 234, a bypass passage port A238, and a connection passage port A239. The atmospheric port 234 and the bypass passage port A238 are formed on one end side of the atmospheric side adsorption passage A232*a*. The connection passage port A239 is formed on the other end side of the atmospheric side adsorption passage A232*a*.

An atmospheric side second hollow chamber A242, a second adsorption chamber 252, a third hollow chamber 243, a third adsorption chamber 253, and a forth hollow chamber 244 are sequentially arranged in the atmospheric side adsorption passage A232*a* from the connection passage port A239 side toward the other side, where the atmospheric port 234 and the bypass passage port A238 are formed. The atmospheric side second hollow chamber A242 is in fluid communication with the connection passage port A239. The fourth hollow chamber 244 is in fluid communication with both the atmospheric port 234 and the bypass passage port A238. The atmospheric side second hollow chamber A242, the second adsorption chamber 252, the third hollow chamber 243, the third adsorption chamber 253, and the forth hollow chamber 244 have the same or almost the same inner shape as each other.

The bypass passage port T238 of the tank side canister housing T232 is connected to the bypass passage port A238 of the atmospheric side canister housing A232 via a bypass passage 236. Thus, the first hollow chamber 241 and the fourth hollow chamber 244 are in fluid communication with each other via the bypass passage 236. The bypass passage 236 is provided with a shutoff valve 237.

The connection passage port T239 of the tank side canister housing T232 is connected to the connection passage port A239 of the atmospheric side canister housing A232 via a connection passage 270. That is, the tank side second hollow chamber T242 and the atmospheric side second hollow chamber A242 are connected to each other via the connection passage 270. The connection passage 270 is provided with a purge port 235 branching from the connection passage 270. The purge port 235 is connected to the air intake passage 16 of the engine 12. In FIG. 6, solid arrows show the flow of the fuel vapor and air mixture from the fuel tank 14 in a state where the purge operation is not being carried out. The dashed arrows show the flow of the atmospheric air and the purge gas during the purge operation.

The first hollow chamber 241 may also be referred to as "a hollow chamber on one end side of a tank side adsorption passage" or "a first hollow chamber positioned at a vapor passage side" in this disclosure. The tank side second hollow chamber T242 may also be referred to as "a hollow chamber on the other end side of a tank side adsorption passage" in this disclosure. The atmospheric side second hollow chamber A242 may also be referred to as "a hollow chamber on the other end side of an atmospheric side adsorption passage" in this disclosure. The tank side second hollow chamber T242 and the atmospheric side second hollow chamber A242 may together function, in effect, as a single hollow chamber (e.g., a second hollow chamber and/or a purging hollow chamber). The third hollow chamber 243 may also be referred to as "a hollow chamber closer to an atmospheric passage side than a hollow chamber directly connected to a connection passage" in this disclosure. The fourth hollow chamber 244 may also be referred to as "a hollow chamber on one end side of an atmospheric side adsorption passage" and "a hollow chamber closer to an atmospheric passage side than an hollow chamber directly connected to a connection passage" in this disclosure.

In the sixth embodiment, the first hollow chamber 241 and the tank side second hollow chamber T242 have the same or substantially the same inner shape as the corresponding ends of the first adsorption chamber 251, respectively. Thus, the gas can flow from the first hollow chamber 241 into the first adsorption chamber 251 or from the tank side second hollow chamber T242 into the first adsorption chamber 251 without much disturbance.

The atmospheric side second hollow chamber A242, the second adsorption chamber 252, the third hollow chamber 243, the third adsorption chamber 253, and the forth hollow chamber 244 have the same or almost the same inner shape as each other. Thus, the gas can flow from the atmospheric side second hollow chamber A242 into the second adsorption chamber 252, from the third hollow chamber 243 into the third adsorption chamber 253, from the fourth hollow chamber 244 into the third adsorption chamber 253, or from the third hollow chamber 243 into the second adsorption chamber 252 without much disturbance.

The tank side canister housing T232 is disposed in the fuel tank 14 and includes the tank port 233, the bypass passage port T238, and the connection passage port T239. Accordingly, the tank side canister housing T232 can be easily mounted to the vehicle by attaching the fuel tank 14 to a vehicle body. Subsequently, the vapor passage 20, the connection passage 270, and the bypass passage 236 may be connected to the tank port 233, the connection passage port T239, and the bypass passage port T238, respectively. In addition, the adsorbent 50 in the tank side canister housing T232 is heated by the fuel stored in the fuel tank 14, the temperature of which is increased by the heat of the engine 12 or the like. The increased heat improves the desorption efficiency of the fuel vapor during the purge operation. The adsorption efficiency may also be improved at beneficial times. For instance, when fuel, which has low temperature because it has been stored in an underground tank of a gas station or the like, is supplied to the fuel tank 14, the adsorbent 50 in the tank side canister housing T232 is cooled by the newly supplied fuel. Thus, the adsorption efficiency of the fuel vapor can be improved during refueling. Further benefits include the length of the vapor passage 20 connecting the tank port 233 of the tank side canister housing T232 to the fuel tank 14 being decreased in comparison with a case in which the tank side canister housing T232 is disposed outside the fuel tank 14.

In this embodiment, the tank side canister housing T232 is integrated with the lid 62 of the fuel tank 14. Thus, the tank side canister housing T232 can be easily disposed in the fuel tank 14, for instance merely by attaching the lid 62 to the fuel tank 14.

The atmospheric side canister housing A232 including the connection passage port A239, the atmospheric port 234, and the bypass passage port A238 forms the atmospheric side adsorption passage A232*a*. Thus, the atmospheric side canister housing A232 can be mounted on a vehicle by attaching the atmospheric side canister housing A232 to a vehicle body and connecting the connection passage 270, atmospheric passage 21, and the bypass passage 236 to the connection passage port A239, the atmospheric port 234, and the bypass passage port A238, respectively. Therefore, the atmospheric side canister housing A232 can be easily mounted on the vehicle. In addition, the canister 230 is divided into the atmospheric side canister housing A232 and the tank side canister housing T232, so that the size of the atmospheric side canister housing A232 can be decreased while securing a required performance of the canister 230 in comparison to a case where a canister is formed in a single component. Accordingly, the space needed to mount the atmospheric side canister housing A232 on the vehicle can be decreased, thereby improving the mountability of the atmospheric side canister housing A232 on the vehicle.

Figure 7:
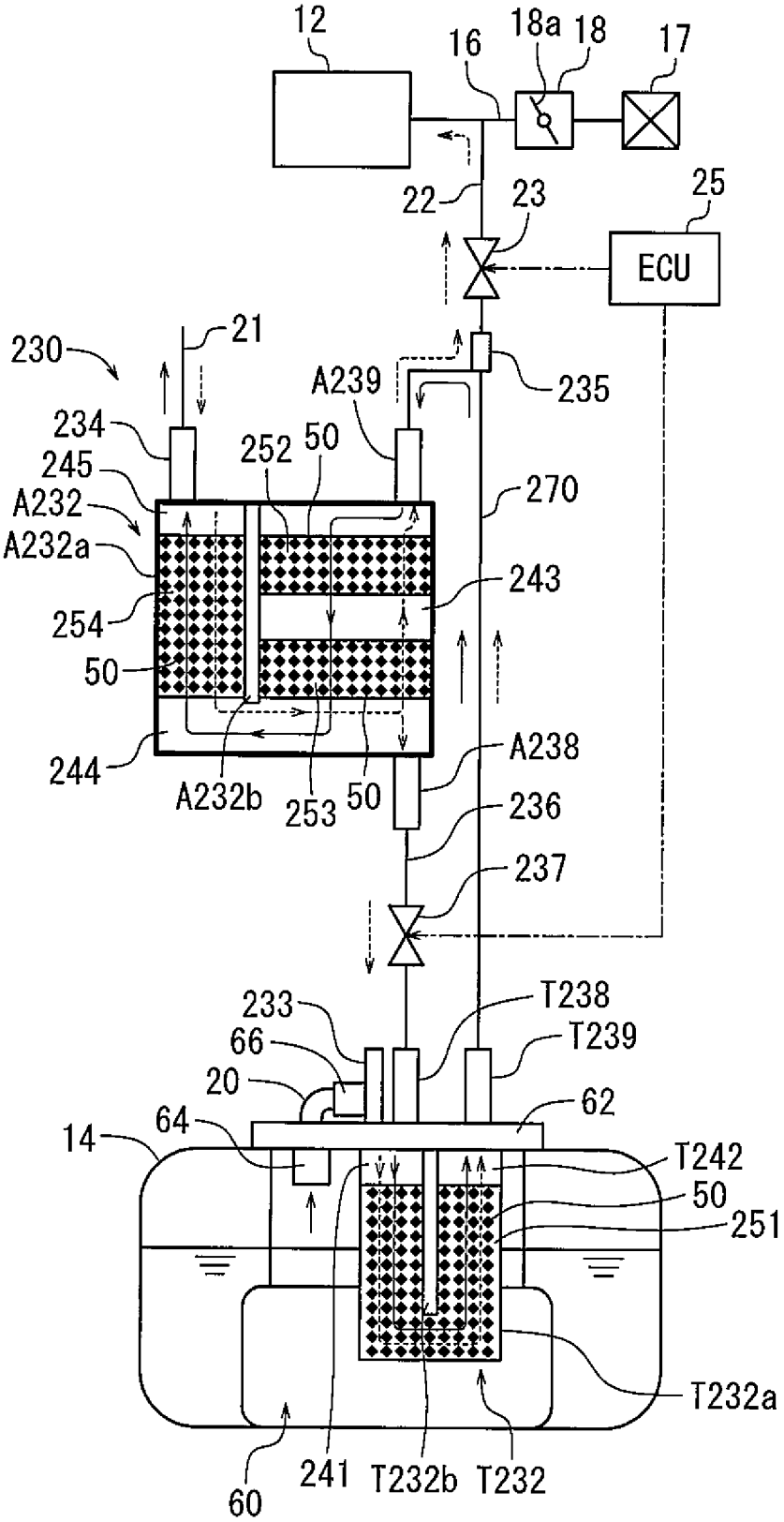
FIG. 7 is a schematic view of a seventh embodiment of a vapor leakage prevention system in accordance with principles described herein.

A seventh embodiment will be described. The seventh embodiment is substantially the same as the sixth embodiment described above. Thus, while the differences will be described, similar configurations will not be described in the interest of conciseness. As shown in FIG. 7, this embodiment includes a fourth adsorption chamber 254 and a fifth hollow chamber 245 between the fourth hollow chamber 244 and the atmospheric port 234.

The atmospheric side canister housing A232 includes a partition wall A232*b* therein. Accordingly, the atmospheric side adsorption passage A232*a* is substantially U-shaped within the atmospheric side canister housing A232. Accordingly, the atmospheric side adsorption passage A232*a* has a pair of parallel straight portions and a bent part that connects the straight portions to each other.

The fourth adsorption chamber 254 and the fifth hollow chamber 245 are formed in one (e.g., the left one in FIG. 7) of the straight portion of the atmospheric side adsorption passage A232*a*. The fifth hollow chamber 245 is in fluid communication with the atmospheric port 234. The fourth hollow chamber 244 is formed in the bent part of the atmospheric side adsorption passage A232*a*. The fourth hollow chamber 244 is in direct fluid communication with both the third adsorption chamber 253 and the fourth adsorption chamber 254. In FIG. 7, solid arrows show the flow of the air and fuel vapor mixture from the fuel tank 14 in a state where the purge operation is not being performed. The dashed arrows show the flow of the air and the purge gas during the purge operation. The fifth hollow chamber 245 may also be referred to as "a hollow chamber on one end side of an atmospheric side adsorption passage" and "a hollow chamber closer to an atmospheric passage side than an hollow chamber directly connected to a connection passage" in this disclosure.

In accordance with the seventh embodiment, the atmospheric side adsorption passage A232*a* additionally includes the fourth adsorption chamber 254, so that the capacity for adsorbing the fuel vapor can be increased in comparison with the sixth embodiment.

The fifth hollow chamber 245 has the same or substantially the same inner shape as the fourth adsorption chamber 254. Thus, the gas can flow from the fifth hollow chamber 245 into the fourth adsorption chamber 254 without much disturbance.

Figure 8:
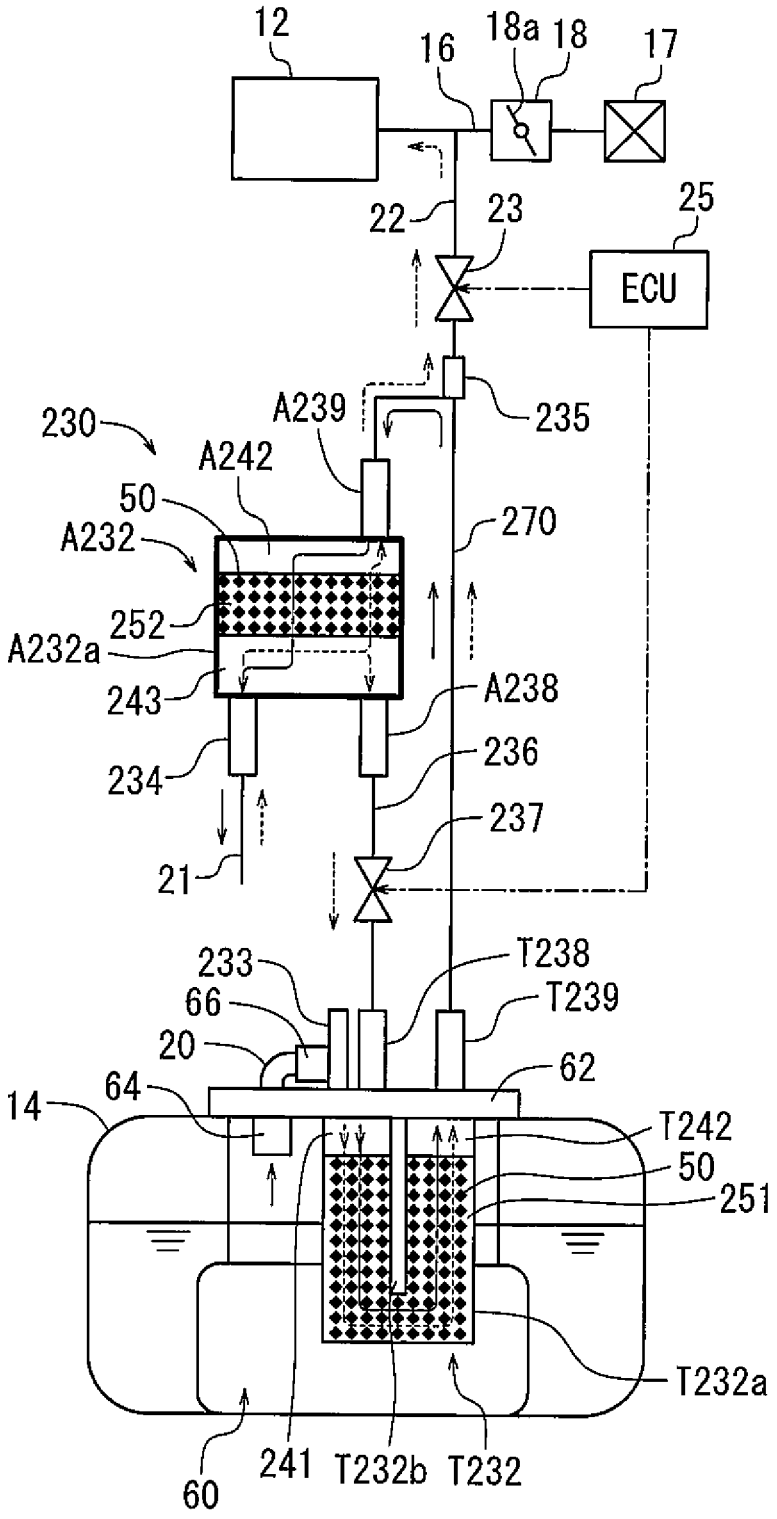
FIG. 8 is a schematic view of an eighth embodiment of a vapor leakage prevention system in accordance with principles described herein.

An eighth embodiment will be described. The eighth embodiment is substantially the same as the sixth embodiment described above. Thus, while the differences will be described, similar configurations will not be described in the interest of conciseness. As shown in FIG. 8, in the eighth embodiment, the atmospheric side adsorption passage A232*a* includes the atmospheric side second hollow chamber A242, the second adsorption chamber 252, and the third hollow chamber 243 only. More specifically, the third adsorption chamber 253 and the fourth hollow chamber 244 of the sixth embodiment are omitted in the eighth embodiment. The third hollow chamber 243 is in fluid communication with both the atmospheric port 234 and the bypass passage port A238. In FIG. 8, solid arrows show the flow of the air and fuel vapor mixture from the fuel tank 14 in a state where the purge operation is not being carried out. The dashed arrows show the flow of the atmospheric air and the purge gas during the purge operation. The third hollow chamber 243 may also be referred to as "a hollow chamber on one end side of an atmospheric side adsorption passage" or "a hollow chamber closer to an atmospheric passage side than an hollow chamber directly connected to a connection passage" in this disclosure.

In accordance with the eighth embodiment, an internal structure of the atmospheric side canister housing A232 can be simplified.

What is claimed is:

1. A fuel vapor processing apparatus, comprising:

an adsorption passage having a first end and a second end, wherein the adsorption passage comprises a first hollow chamber, a second hollow chamber, a third hollow chamber, a first adsorption chamber, and a second adsorption chamber, wherein the first hollow chamber, the first adsorption chamber, the second hollow chamber, the second adsorption chamber, and the third hollow chamber are arranged in series along the adsorption passage, and wherein the first adsorption chamber and the second adsorption chamber are filled with an adsorbent configured to adsorb and desorb fuel vapor;

a vapor passage connecting a fuel tank to the first end of the adsorption passage;

an atmospheric passage connected to the second end of the adsorption passage and configured to be in fluid communication with the atmosphere when a purge operation is performed;

a purge passage extending from the second hollow chamber toward an internal combustion engine;

a bypass passage extending from the first hollow chamber to the third hollow chamber, wherein the bypass passage bypasses the second hollow chamber; and a shutoff valve disposed along the bypass passage, wherein the shutoff valve is configured to open and provide fluid communication between the first hollow chamber and the third hollow chamber while the purge operation is performed and configured to be closed and prevent fluid communication between the first hollow chamber and the third hollow chamber while the purge operation is not performed.

2. The fuel vapor processing apparatus of claim 1, wherein:

one of the first hollow chamber, the second hollow chamber, or the third hollow chamber and one of the first adsorption chamber or the second adsorption chamber are adjacent to each other, in direct fluid communication with each other, and have substantially the same inner shape.

3. The fuel vapor processing apparatus of claim 1, further comprising:

a canister housing defining the adsorption passage therein, wherein the canister housing includes a tank port, a purge port, and an atmospheric port; wherein:

the vapor passage, the purge passage, and the atmospheric passage are connected to the tank port, the purge port, and the atmospheric port, respectively; and the bypass passage and the shutoff valve are integrally formed with the canister housing.

4. The fuel vapor processing apparatus of claim 1, wherein:

a first portion of the second hollow chamber is disposed in a first canister housing; and a second portion of the second hollow chamber is disposed in a second canister housing that is spaced apart from the first canister housing.

5. The fuel vapor processing apparatus of claim 4, wherein the first portion of the second hollow chamber and the second portion of the second hollow chamber are coupled to each other by a connection passage.

6. The fuel vapor processing apparatus of claim 4, wherein:

the first canister housing is disposed within the fuel tank; and the second canister housing is disposed outside of the fuel tank.

7. A fuel vapor processing apparatus, comprising:

a tank side adsorption passage having a first end and a second end, wherein the tank side adsorption passage includes:

a first tank side adsorption chamber;

a first tank side hollow chamber disposed between the first tank side adsorption chamber and the first end of the tank side adsorption passage; and a second tank side hollow chamber disposed between the first tank side adsorption chamber and the second end of the tank side adsorption passage;

an atmospheric side adsorption passage having a first end and a second end, wherein the atmospheric side adsorption passage includes:

a first atmospheric side adsorption chamber;

a first atmospheric side hollow chamber disposed between the first atmospheric side adsorption chamber and the first end of the atmospheric side adsorption passage; and a second atmospheric side hollow chamber disposed between the first atmospheric side adsorption chamber and the second end of the atmospheric side adsorption passage;

a vapor passage connecting a fuel tank to the first end of the tank side adsorption passage;

an atmospheric passage connected to the second end of the atmospheric side adsorption passage and configured to be in fluid communication with the atmosphere when a purge operation is performed;

a connection passage connecting the second end of the tank side adsorption passage to the first end of the atmospheric side adsorption passage;

a purge passage connecting the connection passage to an internal combustion engine;

a bypass passage extending from the first tank side hollow chamber to the second atmospheric side hollow chamber, wherein the bypass passage bypasses the second tank side hollow chamber and the first atmospheric side hollow chamber; and a shutoff valve disposed at the bypass passage, wherein the shutoff valve is configured to be open while the purge operation is performed and to be closed while the purge operation is not performed.

8. The fuel vapor processing apparatus of claim 7, wherein:

one of the first tank side hollow chamber or second tank side hollow chamber and the first tank side adsorption chamber are positioned adjacent to each other, in direct fluid communication with each other, and have substantially the same inner shape.

9. The fuel vapor processing apparatus of claim 7, wherein:

one of the first atmospheric side hollow chambers or second atmospheric side hollow chamber and the first atmospheric side adsorption chamber are positioned adjacent to each other, in direct fluid communication with each other, and have substantially the same inner shape.

10. The fuel vapor processing apparatus of claim 7, further comprising a tank side canister housing defining the tank side adsorption passage therein, wherein the tank side canister housing includes a tank port, a tank side connection passage port, and a tank side bypass passage port; wherein:

the vapor passage, the connection passage, and the bypass passage are connected to the tank port, the tank side connection passage port, and the tank side bypass passage port, respectively; and the tank side canister housing is disposed in the fuel tank.

11. The fuel vapor processing apparatus of claim 10, wherein the tank side canister housing is integrated with a lid of the fuel tank.

12. The fuel vapor processing apparatus of claim 7, further comprising an atmospheric side canister housing defining the atmospheric side adsorption passage therein, wherein the atmospheric side canister housing includes an atmospheric side connection passage port, an atmospheric port, and an atmospheric side bypass passage port, wherein the connection passage, the atmospheric passage, and the bypass passage are connected to the atmospheric side connection passage port, the atmospheric port, and the atmospheric side bypass passage port, respectively.

* * * * *